US010823200B2

(12) United States Patent
Sakaguchi et al.

(10) Patent No.: US 10,823,200 B2
(45) Date of Patent: Nov. 3, 2020

(54) CONNECTED THREAD GROOVE SPACER AND VACUUM PUMP

(71) Applicant: Edwards Japan Limited, Chiba (JP)

(72) Inventors: Yoshiyuki Sakaguchi, Chiba (JP); Tooru Miwata, Chiba (JP); Kengo Saegusa, Chiba (JP); Nahoko Yoshihara, Chiba (JP)

(73) Assignee: Edwards Japan Limited, Chiba (JP)

( * ) Notice: Subject to any disclaimer, the term of this patent is extended or adjusted under 35 U.S.C. 154(b) by 98 days.

(21) Appl. No.: 15/780,155

(22) PCT Filed: Dec. 8, 2016

(86) PCT No.: PCT/JP2016/086591
§ 371 (c)(1),
(2) Date: May 30, 2018

(87) PCT Pub. No.: WO2017/099182
PCT Pub. Date: Jun. 15, 2017

(65) Prior Publication Data

US 2018/0355888 A1 Dec. 13, 2018

(30) Foreign Application Priority Data

Dec. 9, 2015 (JP) ..... 2015-240009

(51) Int. Cl.
*F04D 29/54* (2006.01)
*F04D 19/04* (2006.01)
*F04D 17/16* (2006.01)

(52) U.S. Cl.
CPC ..... *F04D 29/547* (2013.01); *F04D 17/168* (2013.01); *F04D 19/04* (2013.01); *F04D 19/042* (2013.01); *F04D 19/046* (2013.01)

(58) Field of Classification Search
CPC ..... F04D 17/168; F04D 19/042; F04D 19/046
(Continued)

(56) References Cited

U.S. PATENT DOCUMENTS 5,695,316 A 12/1997 Schutz et al.
6,168,374 B1 1/2001 Stolle et al.
(Continued)

FOREIGN PATENT DOCUMENTS

JP H0220798 2/1990
JP H0319491 2/1991
(Continued)

OTHER PUBLICATIONS

Communication dated Jun. 28, 2019 and Supplementary European Search Report dated Jun. 19, 2019 for corresponding European application Serial No. 16873075.2.
(Continued)

*Primary Examiner* — Justin D Seabe
*Assistant Examiner* — Andrew J Marien
(74) *Attorney, Agent, or Firm* — Theodore M. Magee; Westman, Champlin & Koehler, P.A.

(57) ABSTRACT

A thread groove pump portion, which is an exhaust element, is structured such that a Siegbahn structure is attached onto a cylindrical thread, and such that respective parts are connected to each other at this attachment section. A flow channel of the Siegbahn portion and a flow channel of the cylindrical thread (the thread groove pump portion) are connected to each other so as to substantially form a right angle when viewed from an axis direction of the vacuum pump, thus, the flow channel of the Siegbahn portion and the flow channel of the thread groove pump portion are connected to each other. the length of a compression flow channel of the thread groove pump portion can be increased in a radial direction due to the connected Siegbahn portion.

9 Claims, 14 Drawing Sheets

(58) Field of Classification Search
USPC ..... 415/90
See application file for complete search history.

(56) References Cited

U.S. PATENT DOCUMENTS

| | | | | |
|---|---|---|---|---|
| 10,253,777 | B2 * | 4/2019 | Sakaguchi | F04D 19/044 |
| 2002/0098092 | A1 * | 7/2002 | Yamashita | F04D 17/168 417/286 |
| 2002/0122729 | A1 * | 9/2002 | Yamashita | F04D 17/168 417/199.1 |
| 2003/0103842 | A1 * | 6/2003 | Nonaka | F04D 19/046 415/90 |
| 2003/0175115 | A1 * | 9/2003 | Okudera | F04D 19/04 415/90 |
| 2003/0175131 | A1 * | 9/2003 | Ishikawa | F04D 19/04 417/353 |
| 2008/0304985 | A1 * | 12/2008 | Onishi | F04D 19/042 417/423.4 |
| 2011/0103934 | A1 * | 5/2011 | Ohtachi | F04D 19/042 415/118 |
| 2013/0243583 | A1 * | 9/2013 | Kawanishi | F04D 19/046 415/191 |
| 2014/0072417 | A1 * | 3/2014 | Tsutsui | F04D 19/042 415/180 |
| 2015/0016958 | A1 * | 1/2015 | Hofmann | F04D 19/042 415/55.5 |
| 2015/0240822 | A1 * | 8/2015 | Sakaguchi | F04D 19/042 415/200 |
| 2016/0069350 | A1 * | 3/2016 | Nonaka | F04D 17/168 415/115 |
| 2016/0138602 | A1 * | 5/2016 | Sakaguchi | F04D 19/04 415/208.1 |
| 2016/0298645 | A1 * | 10/2016 | Nonaka | F04D 17/168 |

FOREIGN PATENT DOCUMENTS

| | | | |
|---|---|---|---|
| JP | H056195 | | 1/1993 |
| JP | H0510289 | A | 1/1993 |
| JP | H0538389 | | 5/1993 |
| JP | H0754079 | | 2/1995 |
| JP | 2005194921 | A | 7/2005 |
| JP | 2014029130 | A | 2/2014 |
| JP | 2015102076 | A | 6/2015 |

OTHER PUBLICATIONS

PCT International Search Report dated Feb. 28, 2017 for corresponding PCT Application Serial No. PCT/JP2016/086591.
PCT International Written Opinion dated Feb. 28, 2017 for corresponding PCT Application Serial No. PCT/JP2016/086591.

* cited by examiner

CONNECTED THREAD GROOVE SPACER AND VACUUM PUMP

CROSS-REFERENCE OF RELATED APPLICATION

This application is a Section 371 National Stage Application of International Application No. PCT/JP2016/086591, filed Dec. 8, 2016, which is incorporated by reference in its entirety and published as WO 2017/099182 A1 on Jun. 15, 2017 and which claims priority of Japanese Application No. 2015-240009, filed Dec. 9, 2015.

BACKGROUND

The present invention relates to a connected thread groove spacer and a vacuum pump. More particularly, the present invention relates to a connected thread groove spacer for realizing downsizing of a thread groove pump portion (cylindrical thread portion) of a vacuum pump having the thread groove pump portion and a Siegbahn pump portion, and the vacuum pump.

A Siegbahn molecular pump having a Siegbahn configuration has a rotating disc (rotating disk) and a stator disc installed with an axial gap (clearance) with the rotating disc. A spiral groove (also referred to as "spiral groove" or "volute groove") flow channel is engraved on a surface of at least one of the rotating disc and the stator disc that opposes the gap. This Siegbahn molecular pump is a vacuum pump that uses the rotating disc to give momentum in the tangential direction of the rotating disk (i.e., the tangential direction in the direction of rotation of the rotating disc), to gas molecules diffusing inside and entering the spiral grooved flow channel, thereby performing exhaust by sending the gas through the spiral groove from the inlet port toward the outlet port advantageously.

In order to industrially utilize such Siegbahn molecular pump or a vacuum pump having a Siegbahn molecular pump portion, since a sufficient compression ratio is not obtained with a single stage of the rotating disc and a single stage of the stator disc, these discs are configured to have multiple stages. However, increasing the number of stages of the discs in order to meet the required compression performance, leads to an increase in the size of the pump itself.

Moreover, in order to increase the number of stages of the discs, each rotating disc needs to be shaped into a semicircle. This creates the necessity to increase the length of an outer cylinder (casing) of the pump to cover the Siegbahn portion (Siegbahn pump portion), again increasing the size of the pump itself.

On the other hand, a thread groove molecular pump with a configuration of a thread groove pump, or particularly a vacuum pump designed to handle high temperatures, is manufactured by increasing the length of a thread groove portion (thread length) or configuring a parallel path in which a plurality of (two or more) flow channels are provided, in order to improve the compression performance of the thread portion (thread groove portion).

However, increasing the thread length results in an increase of the size of the structure surrounding the exhaust structure (such as the casing), and configuring the parallel path results in an increase in the number of complicated parts, hence the manufacturing cost.

FIG. 14 is a diagram for explaining a conventional 1-pass thread type vacuum pump.

For example, in a conventional vacuum pump 1001 having a 1-pass thread groove spacer 2001 with one flow channel, the axial length of the thread groove portion needs to be increased in order to improve the compression performance. Increasing the axial length of the thread groove portion creates the necessity to increase the size of the base 3 accordingly, resulting in an increase of the manufacturing cost.

Japanese Utility Model Application Publication No. H05-38389 describes a configuration in which, for the purpose of improving the pump performance without enlarging the vacuum pump, a thread groove portion is provided between a rotor cylindrical portion and an inner cylinder and an opening is provided at an upstream-side end portion of the cylindrical portion to connect the outside and the inside of the cylindrical portion.

Japanese Utility Model Registration No. 2501275 describes a Siegbahn-shaped (Siegbahn-type) vacuum pump in which, for the purpose of enhancing the exhaust performance and reducing the number of stages of rotating discs and stationary discs, spiral grooves of different directions are provided on opposed surfaces of a plurality of rotating discs and stationary discs near the atmosphere-side low vacuum region.

Japanese Patent Application Publication No. H05-10289 describes a composite dry vacuum pump in which, for the purpose of directly exhausting from the atmospheric pressure, an eddy groove disk-type Siegbahn pump portion that can be operated from the atmospheric pressure is provided and combined with the rear stage of the thread groove pump portion.

Japanese Examined Utility Model Application Publication No. H07-34234 describes a combination vacuum pump in which, for the purpose of achieving a high degree of vacuum, a thread groove pump element, a Siegbahn (Siegbahn pump)-shaped pump element, and a vortex flow pump element are provided in this order.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

However, none of Japanese Utility Model Application Publication No. H05-38389, Japanese Utility Model Registration No. 2501275, Japanese Patent Application Publication No. H05-10289, and Japanese Examined Utility Model Application Publication No. H07-34234 describes the configuration of the section where the Siegbahn pump portion and the thread groove pump portion overlap (i.e., joined).

An object of the present invention, therefore, is to provide a connected thread groove spacer for realizing downsizing of a thread groove pump portion while keeping the exhaust performance, and a vacuum pump in which the connected thread groove spacer is provided.

In order to achieve this object, the invention of the present application described in claim 1 provides a connected thread groove spacer, comprising: a spiral groove portion which has a disc shape and in which a spiral groove with a spiral ridge portion and a spiral root portion is engraved; and a thread groove portion which has a cylindrical shape and in which a thread groove with a thread ridge portion and a thread root portion is formed, the thread groove portion being connected to the spiral groove portion.

The invention of the present application described in claim 2 provides the connected thread groove spacer described in claim 1, wherein, in the spiral groove portion and the thread groove portion, at least one of borderlines between the spiral ridge portion and the spiral root portion, or a first extended line extending from this borderline is connected in a continuous manner to at least one of borderlines between the thread ridge portion and the thread root portion, or a second extended line extending from this borderline, at a connection portion where the spiral groove portion and the thread groove portion are connected to each other.

The invention of the present application described in claim 3 provides the connected thread groove spacer described in claim 2, further, wherein a top surface of the spiral ridge portion and a top surface of the thread ridge portion are connected to each other at the connection portion in a non-continuous manner.

The invention of the present application described in claim 4 provides the connected thread groove spacer described in claim 2, further, wherein the spiral ridge portion and the thread ridge portion are connected to each other at the connection portion in a continuous manner.

The invention of the present application described in claim 5 provides the connected thread groove spacer described in claim 1, wherein, in the spiral groove portion and the thread groove portion, the spiral ridge portion and the thread ridge portion are connected to each other in a continuous manner at a connection portion where the spiral groove portion and the thread groove portion are connected to each other.

The invention of the present application described in claim 6 provides the connected thread groove spacer described in claim 5, further, wherein the spiral ridge portion and the thread ridge portion intersect with each other by being connected to each other at the connection portion, with a borderline surface between the spiral ridge portion and the spiral root portion and a borderline surface between the thread ridge portion and the thread root portion being disposed in a non-continuous manner.

The invention of the present application described in claim 7 provides the connected thread groove spacer described in any one of claims 1 to 6, wherein a value of a first gradient angle, which is a gradient angle between an axis and a thread depth in the thread groove portion, is equal to or smaller than a value of a second gradient angle, which is a gradient angle between an axis perpendicular line perpendicular to the axis and a groove depth in the spiral groove portion.

The invention of the present application described in claim 8 provides the connected thread groove spacer described in any one of claims 1 to 7, wherein a value of a first angle formed by an inner diameter tangent of the spiral groove portion and an inner diameter-side tangent of the spiral ridge portion is equal to or smaller than a value of a second angle formed by an outer diameter tangent of the spiral groove portion and the inner diameter-side tangent of the spiral ridge portion, the first angle being formed to be larger than 15° and the second angle being formed to be smaller than 25°.

The invention of the present application described in claim 9 provides the connected thread groove spacer described in any one of claims 1 to 8, wherein the spiral groove portion and the thread groove portion are formed integrally.

The invention of the present application described in claim 10 provides a vacuum pump, comprising: a housing in which an inlet port and an outlet port are formed; a rotating shaft that is enclosed in the housing and supported rotatably; a rotor blade that is provided on the rotating shaft; a stator blade that is disposed concentrically with the rotor blade and axially opposes the rotor blade with a gap therebetween; and a thread groove pump mechanism that has the connected thread groove spacer described in any one of claims 1 to 9 that is fixed to the housing.

According to the vacuum pump of the present invention that has a thread groove pump portion and a Siegbahn pump portion (Siegbahn portion), reduction of the height of the thread groove pump portion can be realized while keeping the exhaust performance, by connecting the Siegbahn pump portion and the thread groove pump portion to each other.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENT (i) Overview of Embodiment

A connected thread groove spacer according to an embodiment of the present invention has a structure that connects a Siegbahn pump portion and a thread groove pump portion.

More specifically, the thread groove pump portion, which is an exhaust element, is structured such that a Siegbahn structure is attached onto a cylindrical thread, and such that respective parts are connected to each other at this attachment section. In other words, a flow channel of the Siegbahn portion and a flow channel of the cylindrical thread (the thread groove pump portion) are connected to each other so as to substantially form a right angle (to be expressed as "axially perpendicular" for example, hereinafter) when viewed from an axis direction of the vacuum pump, thus, the flow channel of the Siegbahn portion and the flow channel of the thread groove pump portion are connected to each other.

Note that this configuration for connecting these portions can be created integrally by means of casting.

According to this configuration, the length of a compression flow channel of the thread groove pump portion can be increased in a radial direction due to the connected Siegbahn portion.

(ii) Details of Embodiment

The vacuum pump according to the embodiment of the present invention has, on at least one of a stator disc to be provided and a rotating disc to be provided, the Siegbahn pump portion in which a spiral groove with ridge portions and root portions is engraved (provided), and a thread groove pump portion, which is a gas transfer mechanism in which a spiral groove is formed on a surface opposing a rotating cylinder, a thread groove spacer opposing an outer circumferential surface of the rotating cylinder with a predetermined clearance therebetween is provided, and gas is sent toward an outlet port by being guided by a thread groove (spiral groove) as the rotating cylinder rotates at high speed.

Preferred embodiments of the present invention are described hereinafter in detail with reference to FIGS. 1 to 13.

(ii-1) Configuration of Vacuum Pump

Figure 1:
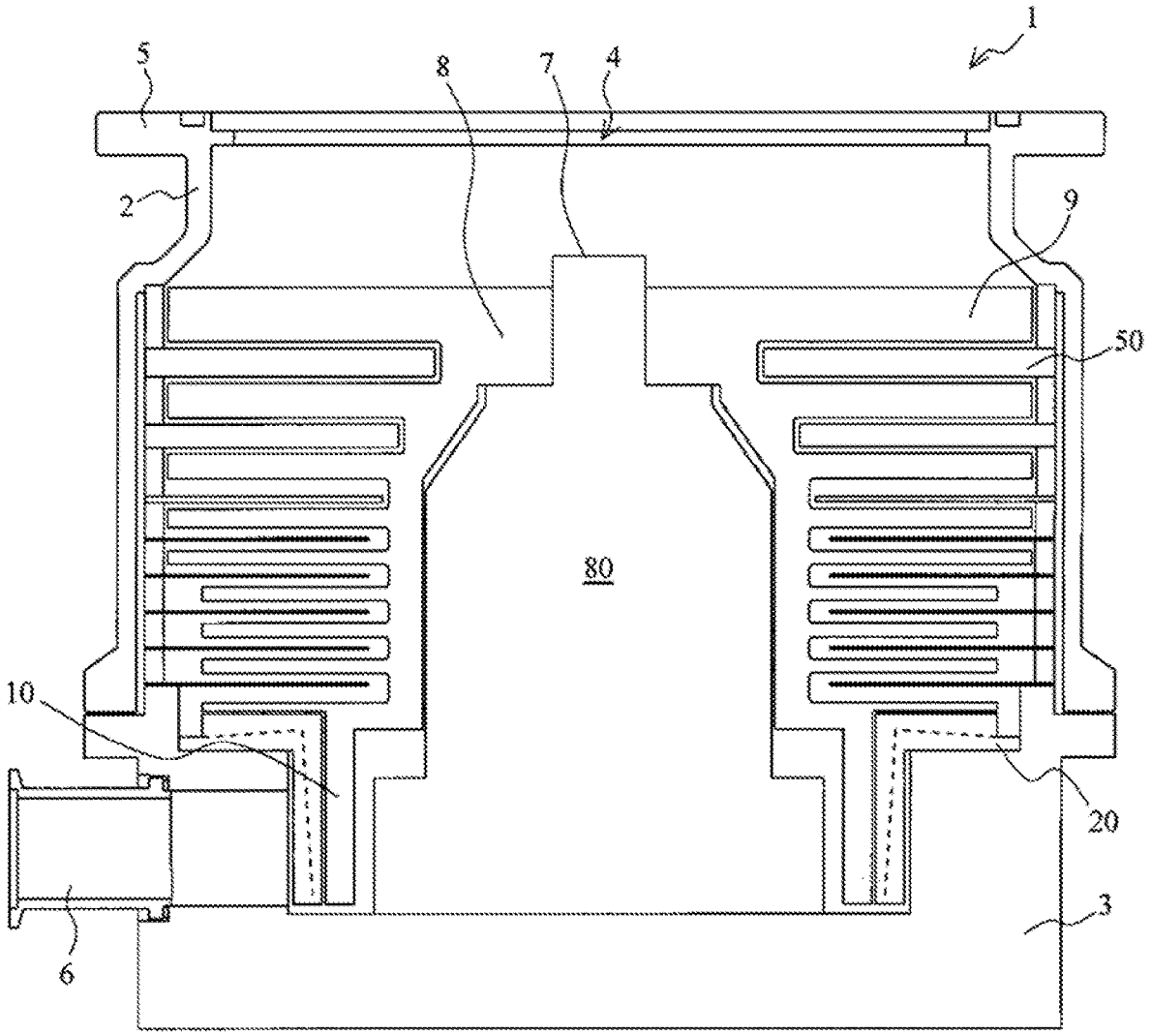
FIG. 1 is a diagram showing a schematic configuration example of a vacuum pump according to an embodiment of the present invention.

FIG. 1 is a diagram showing a schematic configuration example of a vacuum pump 1 according to a first embodiment of the present invention, FIG. 1 being a cross-sectional view taken along an axis direction of the vacuum pump 1.

In the embodiments of the present invention, a diameter direction of rotor blades is referred to as "radial (diametrical) direction", and the direction perpendicular to the diameter direction of the rotor blades is referred to as "axis direction (or axial direction)".

A casing (outer cylinder) 2 forming a housing of the vacuum pump 1 has a substantially cylindrical shape and configures a casing of the vacuum pump 1 along with a base 3 provided at a lower portion of the casing 2 (outlet port 6 side). The gas transfer mechanism, a structure that exhibits the exhaust performance of the vacuum pump 1, is stored in this casing.

In the present embodiment, this gas transfer mechanism is configured roughly by a rotating portion (rotor portion/Siegbahn portion) that is supported rotatably and a stator portion (thread groove pump portion) fixed to the casing.

Although not shown, a control device for controlling the operation of the vacuum pump 1 is connected to the outside of the housing of the vacuum pump 1 by a dedicated line.

An inlet port 4 for introducing gas to the vacuum pump 1 is formed at an end portion of the casing 2. A flange portion 5 protruding toward an outer circumference is formed on an end surface of the casing 2 on the inlet port 4 side.

The outlet port 6 for exhausting gas from the vacuum pump 1 is formed in the base 3.

The rotating portion has a shaft 7, which is a rotating shaft, a rotor 8 provided in this shaft 7, a plurality of rotor blades 9 provided in the rotor 8, and a rotor cylindrical portion 10 provided on the outlet port 6 side (the thread groove pump portion). Note that the rotor portion is configured by the shaft 7 and the rotor 8.

Each of the rotor blades 9 is configured by a disc-shaped disc member extending radially in a direction perpendicular to the axis of the shaft 7. In the present embodiment, the lowest stage of the rotor blades 9 (the outlet port 6 side) is configured as a disk to perform compression of the Siegbahn portion.

The rotor cylindrical portion 10 is configured by a cylindrical member that is concentric with a rotation axis of the rotor 8.

A motor portion for rotating the shaft 7 at high speed is provided approximately axially in the middle of the shaft 7, the motor portion being enclosed in a stator column 80.

Furthermore, radial magnetic bearing devices for supporting the shaft 7 in the radial direction in a non-contact manner are provided within the stator column 80, at the inlet port 4 side and the outlet port side 6 with respect to the motor portion of the shaft 7. Also, an axial magnetic bearing device for supporting the shaft 7 in the axis direction (axial direction) in a non-contact manner is provided at a lower end of the shaft 7.

A stator portion (stator portion) is formed on the inner circumferential side of the casing (casing 2). This stator portion is configured from stator blades 50 or the like which are inclined at a predetermined angle from a plane surface perpendicular to the axis of the shaft 7 and extend from an inner circumferential surface of the casing 2 toward the shaft 7. The stator blades 50 are separated from each other by cylindrical spacers (stator portions) and fixed.

Note that the rotor blades 9 and the stator blades 50 are disposed alternately in a plurality of stages in the axis direction, but in order to meet the exhaust performance required in the vacuum pump, any number or rotor parts and any number of stator parts can be provided if necessary.

Furthermore, in the present embodiment, the thread groove pump portion with a connected thread groove spacer 20 is provided close to the outlet port 6 from the Siegbahn pump portion mentioned above.

As with a conventional thread groove spacer, in the connected thread groove spacer 20, a thread groove (spiral groove) is formed on a surface opposing the rotor cylindrical portion 10.

The surface of the connected thread groove spacer 20 that opposes the rotor cylindrical portion 10 (i.e., an inner circumferential surface parallel to the axis of the vacuum pump 1) opposes an outer circumferential surface of the rotor cylindrical portion 10, with a predetermined clearance therebetween. When the rotor cylindrical portion 10 rotates at high speed, the gas that is compressed in the vacuum pump 1 is sent toward the outlet port 6 by being guided by the thread groove with the rotation of the rotor cylindrical portion 10. Specifically, the thread groove functions as a flow channel for transporting the gas.

As described above, the surface of the connected thread groove spacer 20 which opposes the rotor cylindrical portion 10 opposes the rotor cylindrical portion 10, with the predetermined clearance therebetween, thereby configuring the gas transfer mechanism for transporting the gas by means of the thread groove formed on the axis direction-side inner circumferential surface of the connected thread groove spacer 20.

The smaller the clearance is the better, in order to reduce the force of the gas flowing back toward the inlet port 4.

The direction of the spiral groove formed in the connected thread groove spacer 20 is a direction toward the outlet port 6 when the gas is transported through the spiral groove in the direction of rotation of the rotor 8.

The depth of the spiral groove becomes shallow toward the outlet port 6; the gas transported through the spiral groove becomes compressed more toward the outlet port 6.

According to the foregoing configuration, in the vacuum pump 1, the gas that is drawn through the inlet port 4 is compressed in the Siegbahn portion, then compressed further in the thread groove pump portion, and discharged from the outlet port 6. Therefore, the vacuum pump 1 can perform a vacuum exhaust treatment in a vacuum chamber (not shown) provided in the vacuum pump 1.

(ii-2) Configuration of Connected Thread Groove Spacer

The connected thread groove spacer 20 is now described in detail.

Figure 2:
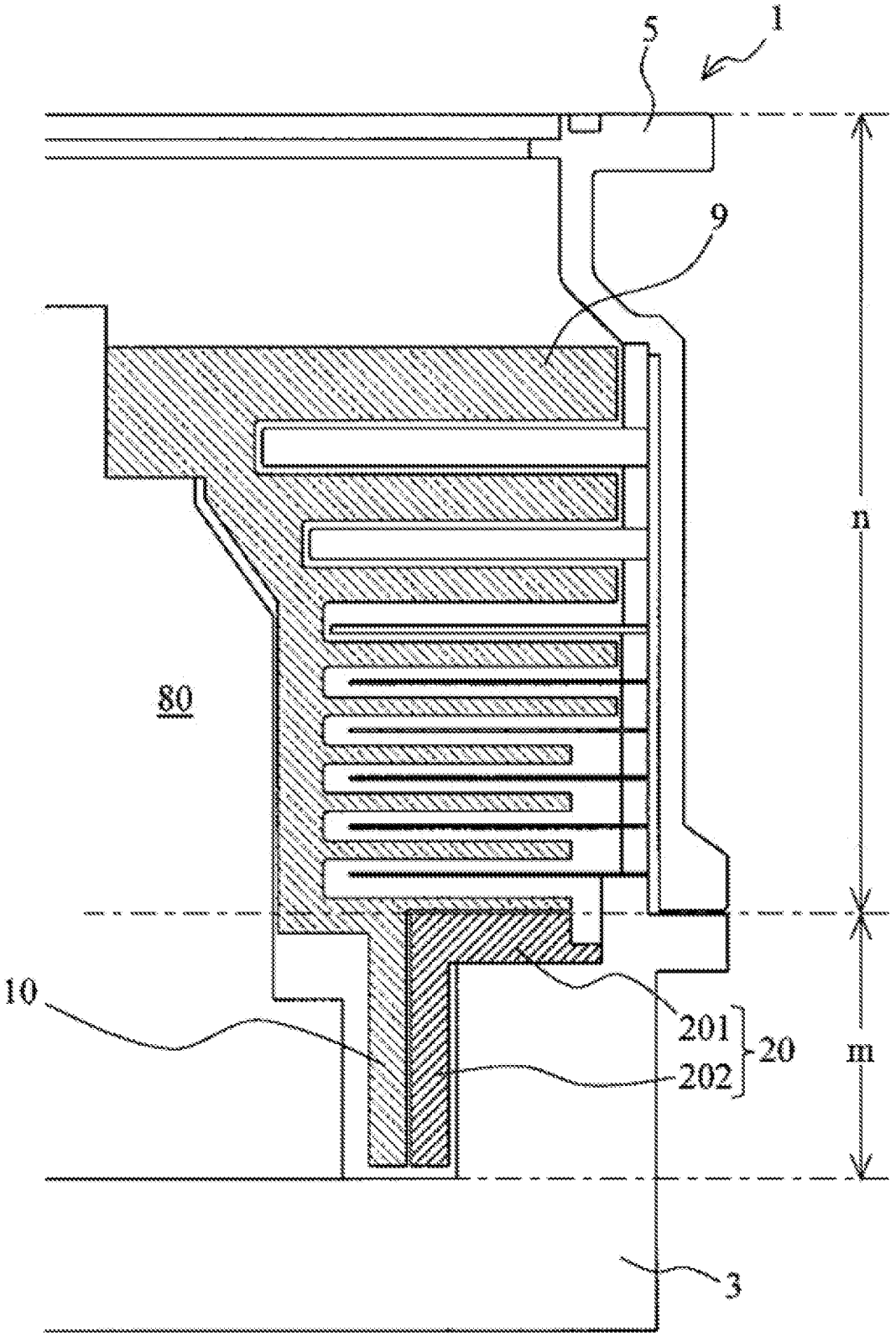
FIG. 2 is a diagram for explaining a connected thread groove spacer according to the embodiment of the present invention.

FIG. 2 is a diagram for explaining the connected thread groove spacer 20 according to the embodiment of the present invention.

As shown in FIG. 2, the connected thread groove spacer 20 according to the present embodiment has a thread groove spacer axis perpendicular portion 201 and a thread groove spacer axis parallel portion 202.

The thread groove spacer axis perpendicular portion 201 is configured to be substantially perpendicular (horizontal) to the axis direction of the vacuum pump 1. A surface of the thread groove spacer axis perpendicular portion 201 at the inlet port 4 side opposes the rotor blades 9 of the Siegbahn portion, with a predetermined clearance therebetween, and has a spiral groove with ridge portions and root portions engraved. On the other hand, a surface of the thread groove spacer axis perpendicular portion 201 on the side opposite to the inlet port 4 is provided on the base 3 side.

The thread groove spacer axis parallel portion 202 is configured to be substantially parallel to the axis direction of the vacuum pump 1. A thread groove is formed on an inner circumferential surface of the thread groove spacer axis parallel portion 202 that opposes the rotor cylindrical portion 10, with a predetermined clearance therebetween.

(ii-3-1) Type 1 of Basic Structure of Connection Portion

Figure 3:
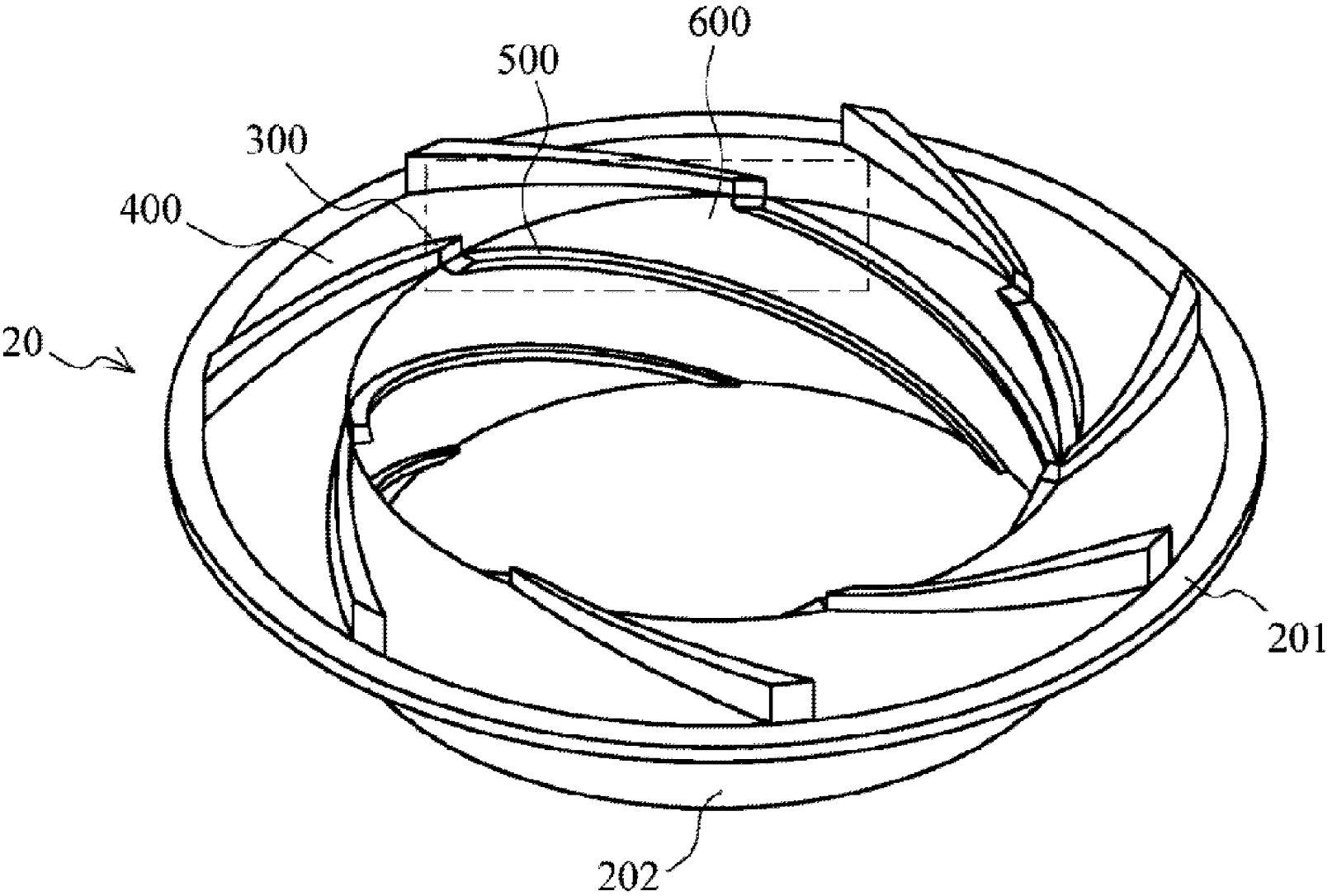
FIG. 3 is a diagram for explaining the connected thread groove spacer according to the embodiment of the present invention.

FIG. 3 is a diagram for explaining the connected thread groove spacer 20 according to the present embodiment.

As described above, a spiral groove with perpendicular portion ridge portions 300 and perpendicular portion root portions 400 is engraved in the thread groove spacer axis perpendicular portion 201, and a thread groove with parallel portion ridge portions 500 and parallel portion root portions 600 is formed in the thread groove spacer axis parallel portion 202.

The connected thread groove spacer 20 of the present embodiment is produced by means of, for example, casting, wherein the thread groove spacer axis perpendicular portion 201 and the thread groove spacer axis parallel portion 202 are integrated to configure the connected thread groove spacer 20, as shown in FIG. 3.

Compared to creating the thread groove spacer axis perpendicular portion 201 and the thread groove spacer axis parallel portion 202 as separate parts and then tightening these parts together, integrally configuring the thread groove spacer axis perpendicular portion 201 and the thread groove spacer axis parallel portion 202 can reduce the time it takes for tightening these parts as well as the cost of manufacturing these parts.

As described above, in the vacuum pump 1 according to the present embodiment, due to the connected thread groove spacer 20 provided therein, the gas is compressed by the thread groove spacer axis perpendicular portion 201 and the rotor blades 9 (the Siegbahn portion), in the flow channel perpendicular to the axial direction. Subsequently, the gas is further compressed by the thread groove spacer axis parallel portion 202 and the rotor cylindrical portion 10 (the thread groove pump portion), in the flow channel parallel to the axial direction.

As described above, in the vacuum pump 1 according to the present embodiment, because the connected thread groove spacer 20 serves to extend the gas flow channel from the direction perpendicular to the axial direction to the direction parallel to the axial direction, a long flow channel for compressing the gas can be obtained without increasing the axial length (n) of the casing 2 or the axial length (m) of the base 3 (i.e., while preventing an increase in the entire height of the vacuum pump 1). Note that the flow channel extending from the perpendicular direction to the parallel direction is in the shape of an inverted "L" when viewed in axial cross section.

In the present embodiment, the thread groove spacer axis perpendicular portion 201 and the thread groove spacer axis parallel portion 202 of the connected thread groove spacer 20 are configured integrally; however, the configuration is not limited thereto. For example, configuring the thread groove spacer axis perpendicular portion 201 and the thread groove spacer axis parallel portion 202 as separate parts shows no problems in terms of performance as long as the thread groove spacer axis perpendicular portion 201 and the thread groove spacer axis parallel portion 202 are formed into an inverted L shape extending from the direction perpendicular to the axial direction to the direction parallel to the axial direction.

Figure 4:
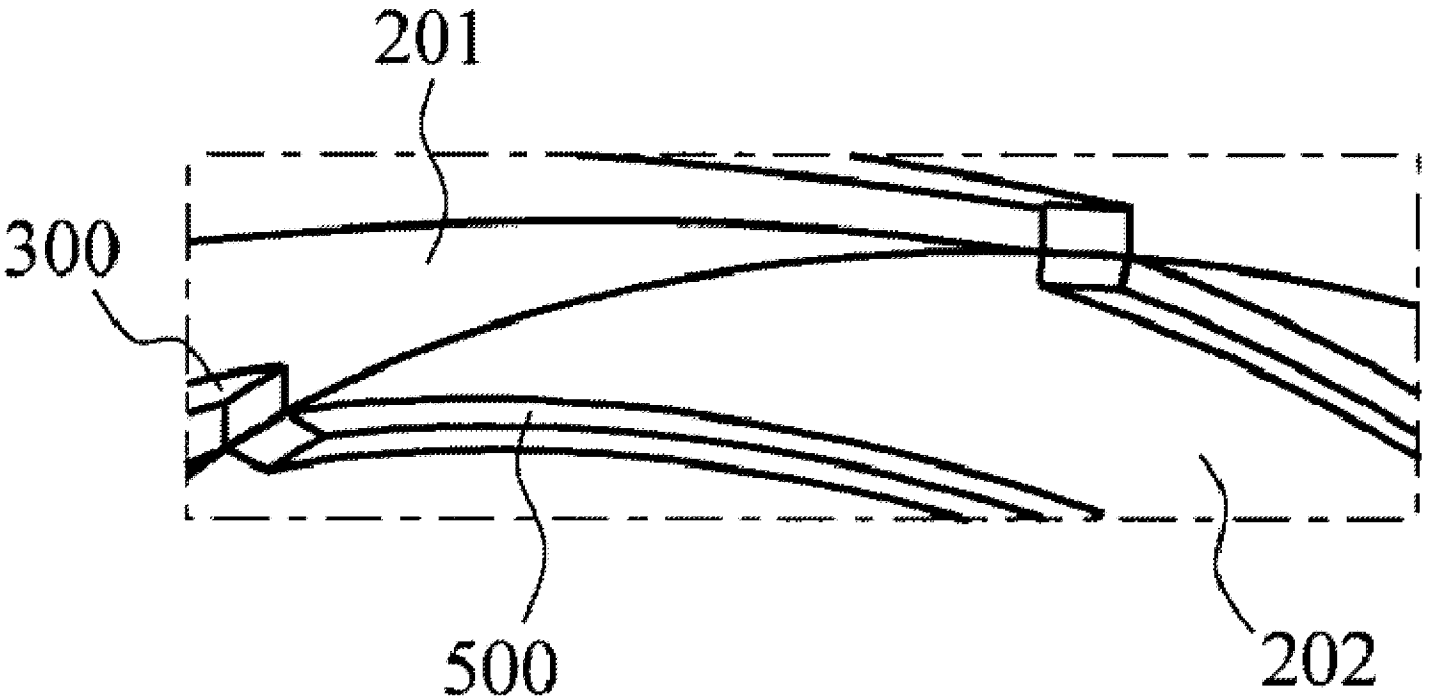
FIG. 4 is a diagram for explaining the connected thread groove spacer according to the embodiment of the present invention.
Figure 5:
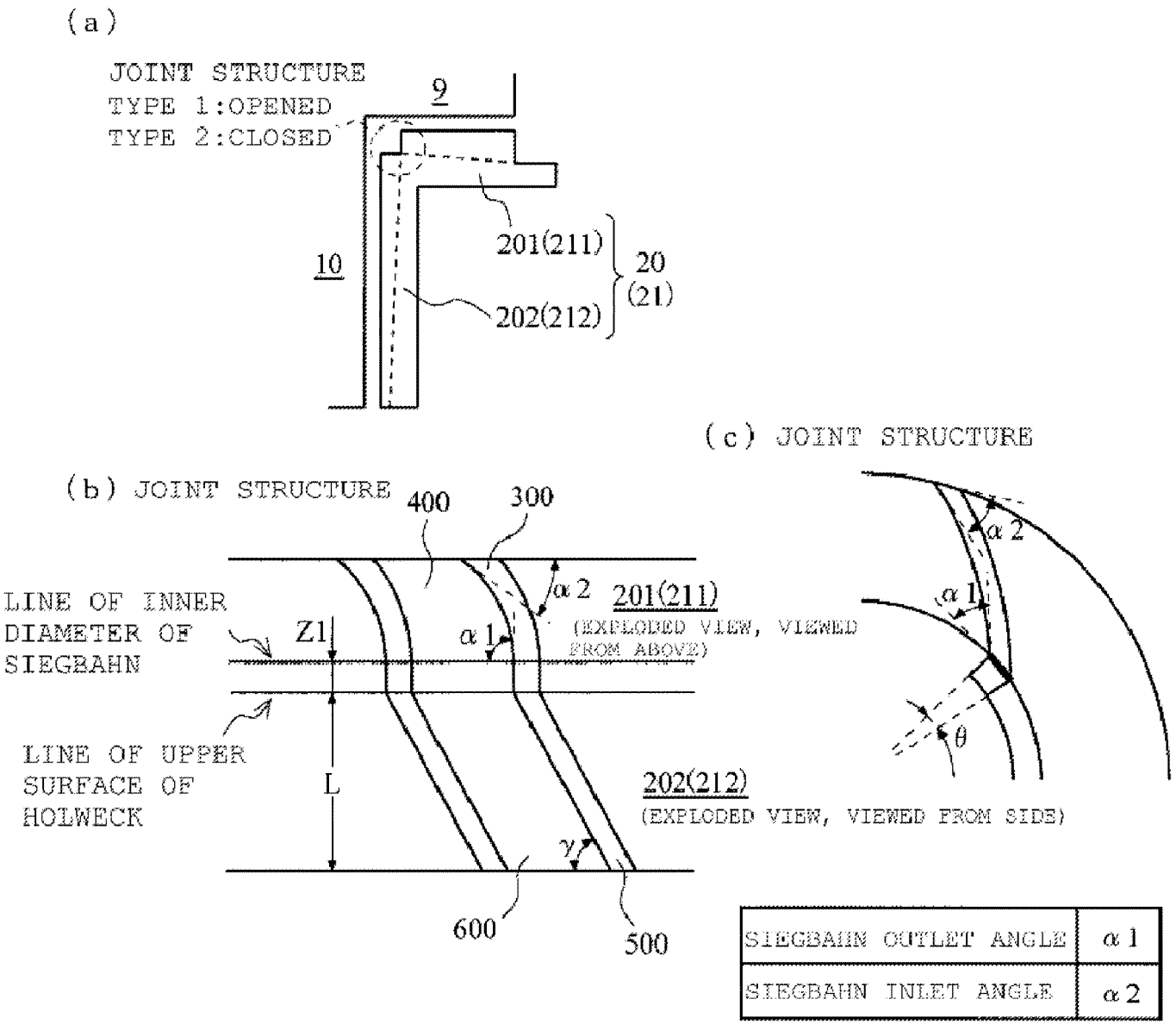
FIGS. 5A to 5C are diagrams for explaining the basic structures of connected thread groove spacers according to the embodiment and Modification 1 of the present invention.

FIG. 4 is a diagram for explaining the connected thread groove spacer 20 according to the present embodiment, showing an enlarged part of FIG. 3.

FIGS. 5A to 5C are diagrams for explaining the basic structure of the connected thread groove spacer 20 according to the embodiment of the present invention (and of a connected thread groove spacer 21 according to Modification 1 described hereinafter).

Note that the details described hereinafter with reference to FIGS. 5A to 5C uses the connected thread groove spacer 20 and the connected thread groove spacer 21 according to Modification 1 described hereinafter. Therefore, reference numerals indicating the connected thread groove spacer 21 (connected thread groove spacer 21, thread groove spacer axis perpendicular portion 211, thread groove spacer axis parallel portion 212) are used to describe the connected thread groove spacer 21 in FIGS. 5A and 5C, and the description using the connected thread groove spacer 21 is omitted.

FIG. 5A is a diagram for explaining a position where the thread groove spacer axis perpendicular portion 201 and the thread groove spacer axis parallel portion 202 are connected to each other (a position of a joint structure), and FIG. 5B is an exploded view for explaining the joint structure in detail.

First, as shown in FIG. 4, in the connected thread groove spacer 20, the thread groove spacer axis perpendicular portion 201 and the thread groove spacer axis parallel portion 202 are joined in such a manner that a borderline between the ridge portion (perpendicular portion ridge portion 300) of the spiral groove engraved in the thread groove spacer axis perpendicular portion 201 and a bottom surface at the root of the ridge portion (i.e., a borderline surface between the ridge portion and the root portion), and a borderline between the ridge portion (parallel portion ridge portion 500) of the thread groove formed in the thread groove spacer axis parallel portion 202 and a bottom surface at the root of the ridge portion (i.e., a borderline surface between the ridge portion and the root portion) or the extended lines of the borderlines extend smoothly in a continuous manner without being shifted from each other. For distinction, the extended line of the borderline of the spiral groove is defined as a first extended line, and the extended line of the borderline of the thread groove is defined as a second extended line.

Moreover, in the perpendicular portion ridge portion 300 of the thread groove spacer axis perpendicular portion 201 and the parallel portion ridge portion 500 of the thread groove spacer axis parallel portion 202, the ridge portions (the perpendicular portion ridge portion 300 and the parallel portion ridge portion 500) of the two portions (the thread groove spacer axis perpendicular portion 201 and the thread groove spacer axis parallel portion 202) are configured to be continuous with each other on the extended lines of the borderlines between the respective ridge portions and the bottom surfaces at the joint (connection portion) between the thread groove spacer axis perpendicular portion 201 and the thread groove spacer axis parallel portion 202, but the ridge portions themselves (the top surfaces or peak surfaces) are not configured to be continuous, and configured in a non-continuous manner. In other words, a circumferential direction of the gas passage (flow channel) is opened.

The joint here represents the whole area in which the thread groove spacer axis perpendicular portion 201 and the thread groove spacer axis parallel portion 202 of the connected thread groove spacer 20 overlap (meet) and that opposes the rotor blades 9 and the rotor cylindrical portion 10, as shown in FIG. 5A.

FIGS. 5B and 5C are exploded views in which the abovementioned joint of the connected thread groove spacer 20 is viewed from above (the rotor blade 9 side) and from the side (the rotor cylindrical portion 10).

As shown in FIGS. 5B and 5C, in the connected thread groove spacer 20, the perpendicular portion ridge portion 300 and the perpendicular portion root portion 400 have a predetermined outlet angle ($\alpha$1: defined as a first angle) at the inner diameter side (inner circumference side) of the thread groove spacer axis perpendicular portion 201 that corresponds to the outlet of the Siegbahn portion. This outlet angle $\alpha$1 is formed by an inner diameter tangent of the thread groove spacer axis perpendicular portion 201 and an inner diameter-side tangent of the perpendicular portion ridge portion 300.

Also, the perpendicular portion ridge portion 300 and the perpendicular portion root portion 400 have a predetermined inlet angle ($\alpha$2: defined as a second angle) at the outer diameter side (outer circumference side) of the thread groove spacer axis perpendicular portion 201 that corresponds to the inlet of the Siegbahn portion. This inlet angle $\alpha$2 is formed by an outer diameter tangent of the thread groove spacer axis perpendicular portion 201 and the inner diameter-side tangent of the perpendicular portion ridge portion 300.

Furthermore, in the connected thread groove spacer 20, the parallel portion ridge portion 500 and the parallel portion root portion 600 have a predetermined lead angle ($\gamma$) at the inner diameter side of the outlet (the outlet port 6 side) of the thread groove spacer axis parallel portion 202. In this embodiment, the thread sectional area of the thread groove spacer axis parallel portion 202 in the joint structure becomes larger as the value of this lead angle $\gamma$ becomes smaller Therefore, in the present embodiment in which the ridge width (the width of the top surface) of the Siegbahn portion is formed by taking an outer circumferential line of the cross section of the parallel portion ridge portion 500 on an upper surface of the thread groove portion (the thread groove spacer axis parallel portion 202) as a phase angle $\theta$ of the Siegbahn portion (the thread groove spacer axis perpendicular portion 201), the phase angle ($\theta$) of the ridge portion of the Siegbahn portion becomes large as well.

Note that Z1 represents the depth of the outlet of the Siegbahn portion, or more specifically the length of the section between the line of the inner diameter of the thread groove spacer axis perpendicular portion 201 (the Siegbahn portion) and the line of the upper surface of the thread groove spacer axis parallel portion 202 (Holweck). "L" represents the axial length of the thread groove spacer axis parallel portion 202.

(ii-3-2) Type 2 of Basic Structure of Connection Portion (Modification 1)

Figure 6:
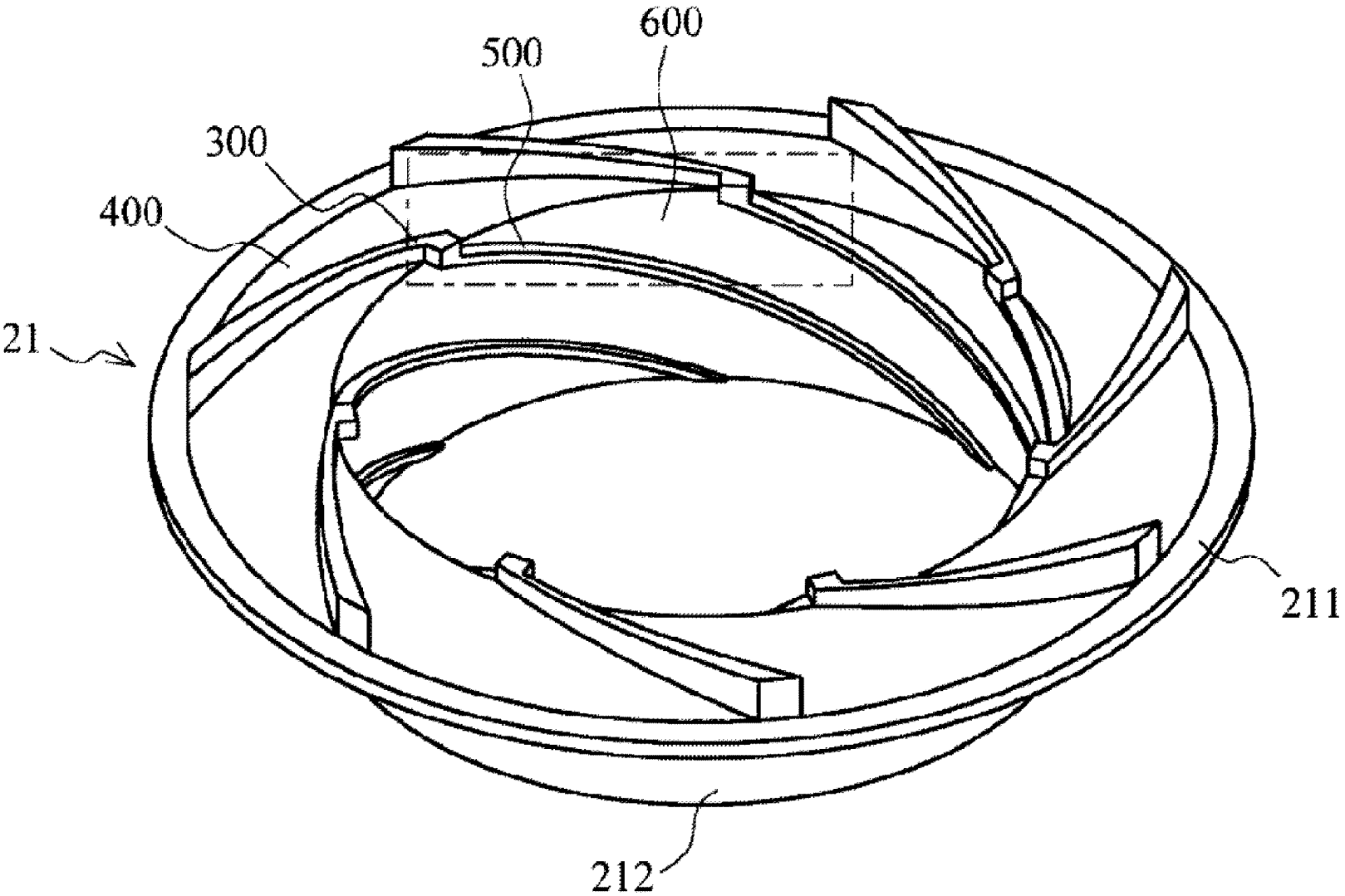
FIG. 6 is a diagram for explaining the connected thread groove spacer according to Modification 1 of the embodiment of the present invention.
Figure 7:
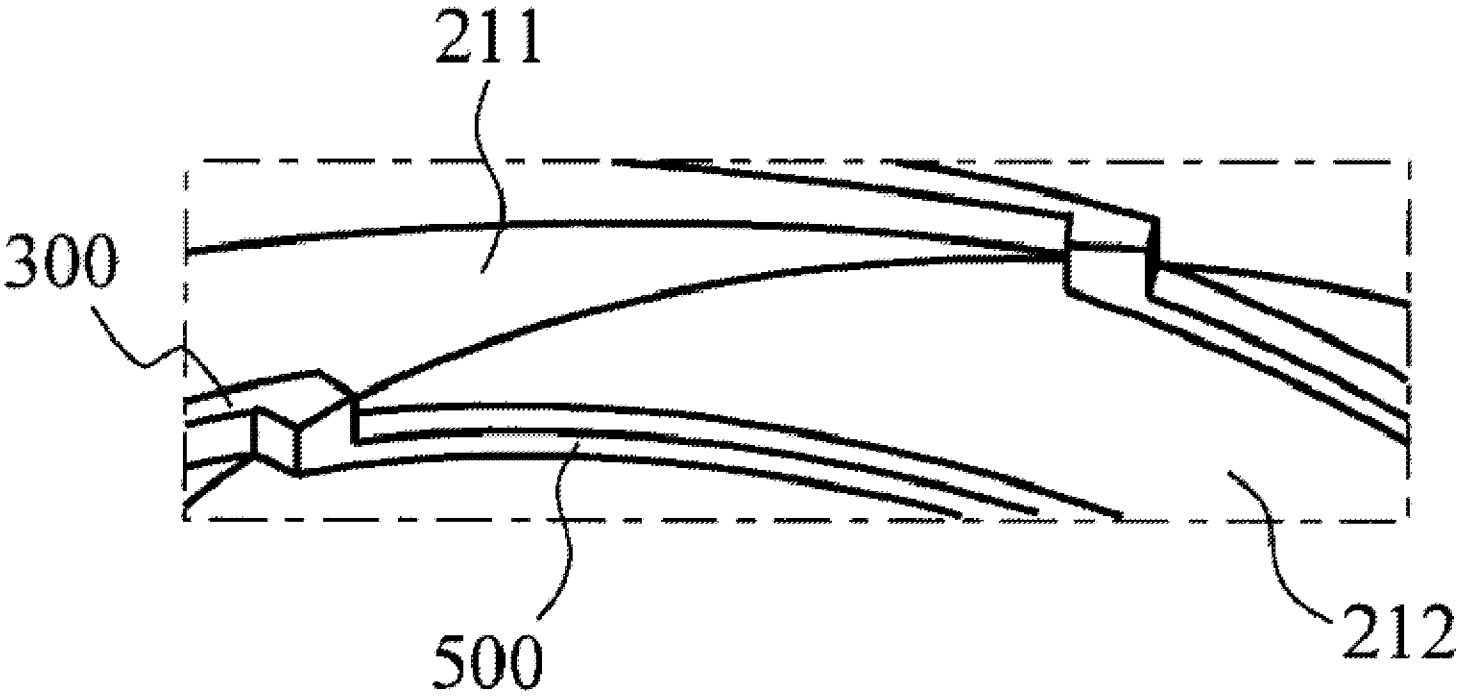
FIG. 7 is a diagram for explaining the connected thread groove spacer according to Modification 1 of the embodiment of the present invention.

FIGS. 6 and 7 are diagrams for explaining the connected thread groove spacer 21 according to Modification 1 of the present embodiment, FIG. 7 being a diagram showing an enlarged part of FIG. 6.

As shown in FIGS. 6 and 7, in the connected thread groove spacer 21 according to Modification 1, as with the connected thread groove spacer 20 described above, the thread groove spacer axis perpendicular portion 211 and the thread groove spacer axis parallel portion 212 are joined in such a manner that a borderline between the ridge portion (perpendicular portion ridge portion 300) of the spiral groove engraved in the thread groove spacer axis perpendicular portion 211 and a bottom surface at the root of the ridge portion (i.e., a borderline surface between the ridge portion and the root portion), and a borderline between the ridge portion (parallel portion ridge portion 500) of the thread groove formed in the thread groove spacer axis parallel portion 212 and a bottom surface at the root of the ridge portion (i.e., a borderline surface between the ridge portion and the root portion) or the extended lines of the borderlines extend smoothly in a continuous manner without being shifted from each other.

However, according to the connected thread groove spacer 21 of Modification 1, unlike the connected thread groove spacer 20, in the perpendicular portion ridge portion 300 of the thread groove spacer axis perpendicular portion 211 and the parallel portion ridge portion 500 of the thread groove spacer axis parallel portion 212, the ridge portions (the perpendicular portion ridge portion 300 and the parallel portion ridge portion 500) of the two portions (the thread groove spacer axis perpendicular portion 211 and the thread groove spacer axis parallel portion 212) are formed to be continuous with each other (FIG. 5A) at the joint (FIG. 5A) between the thread groove spacer axis perpendicular portion 211 and the thread groove spacer axis parallel portion 212. In other words, the circumferential direction of the gas passage (flow channel) is not opened (i.e., closed).

(ii-3-3) Type 3 of Basic Structure of Connection Portion (Modification 2)

Figure 8:
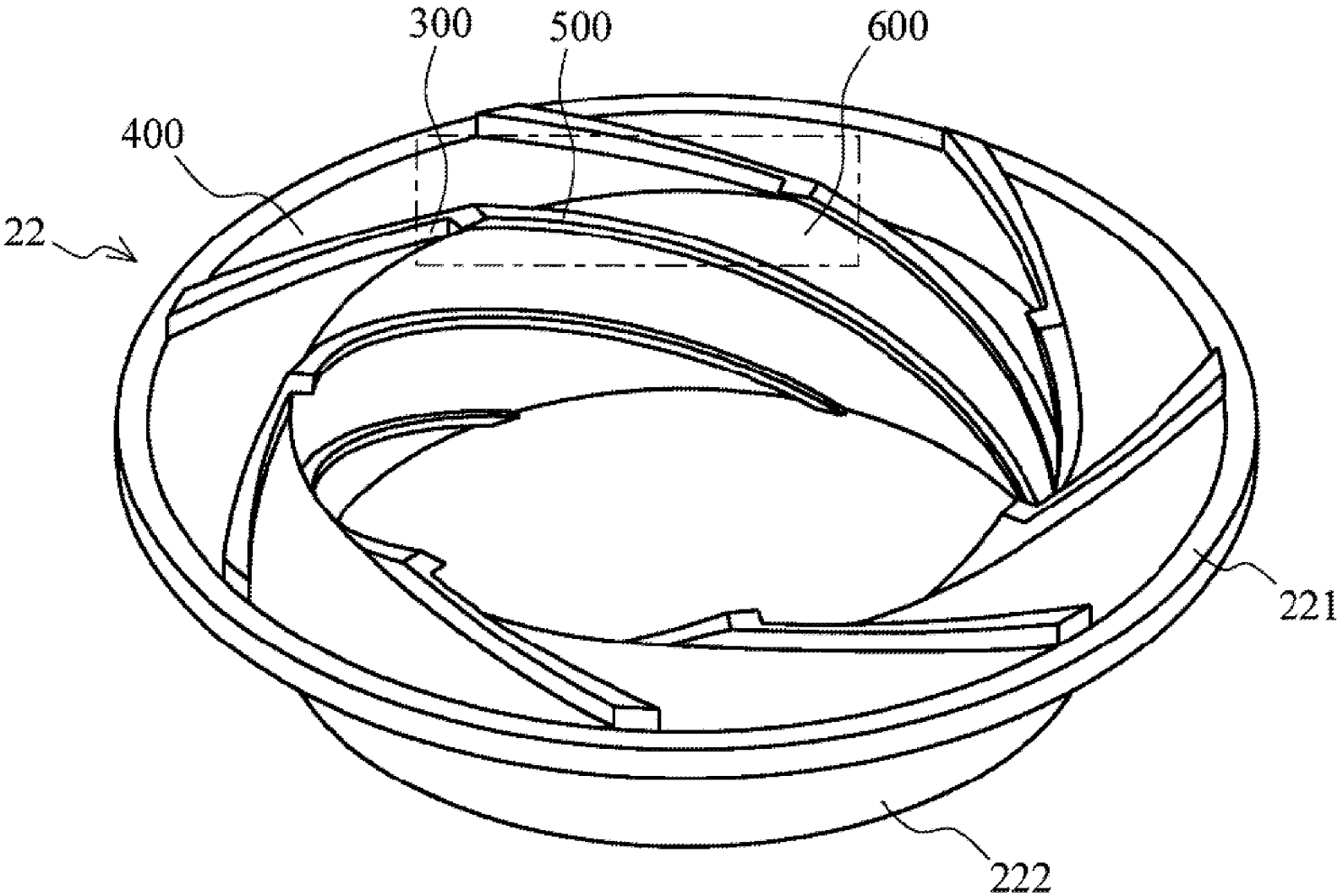
FIG. 8 is a diagram for explaining a connected thread groove spacer according to Modification 2 of the embodiment of the present invention.
Figure 9:
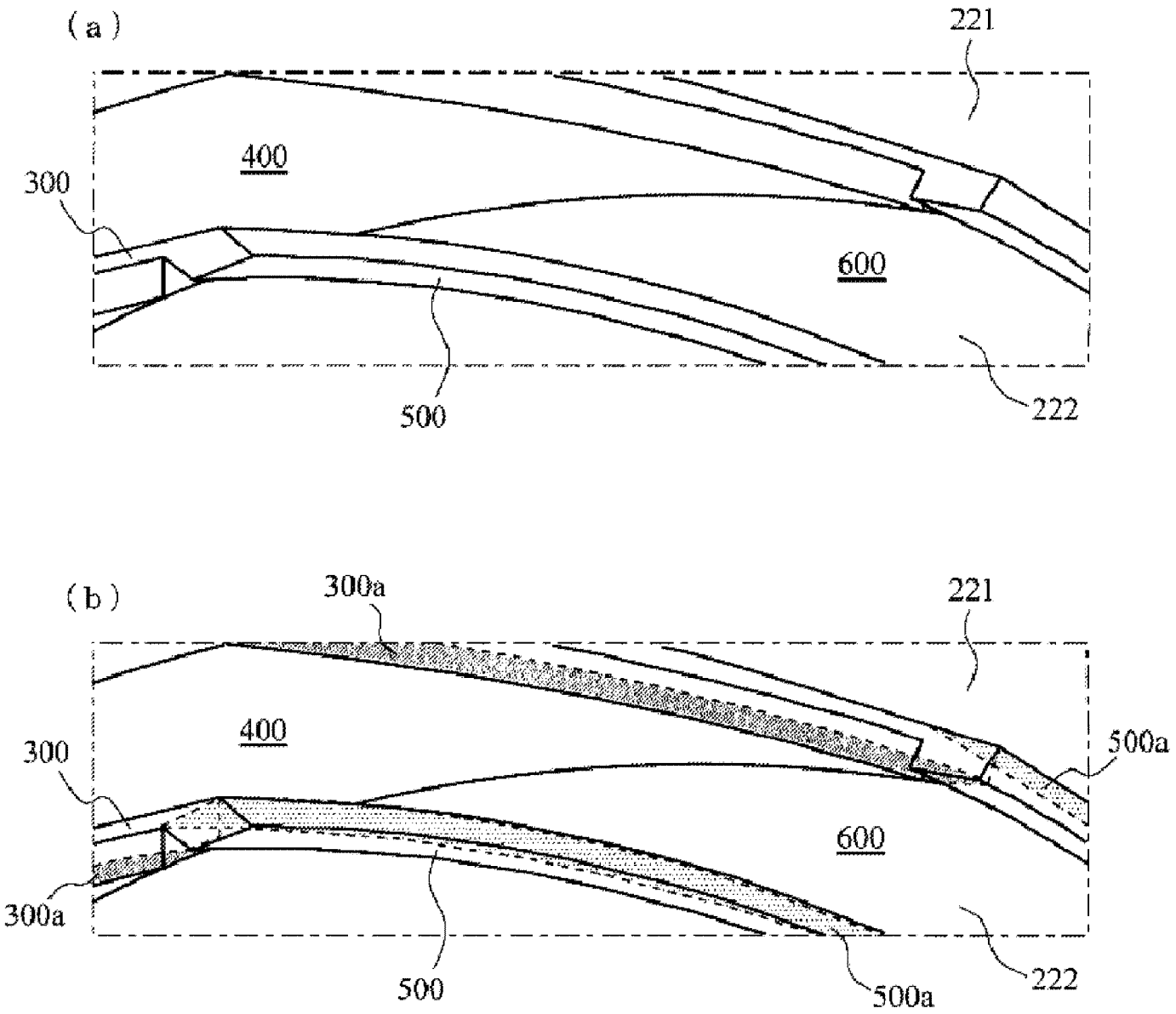
FIGS. 9A and 9B are diagrams for explaining the connected thread groove spacer according to Modification 2 of the embodiment of the present invention.
Figure 10:
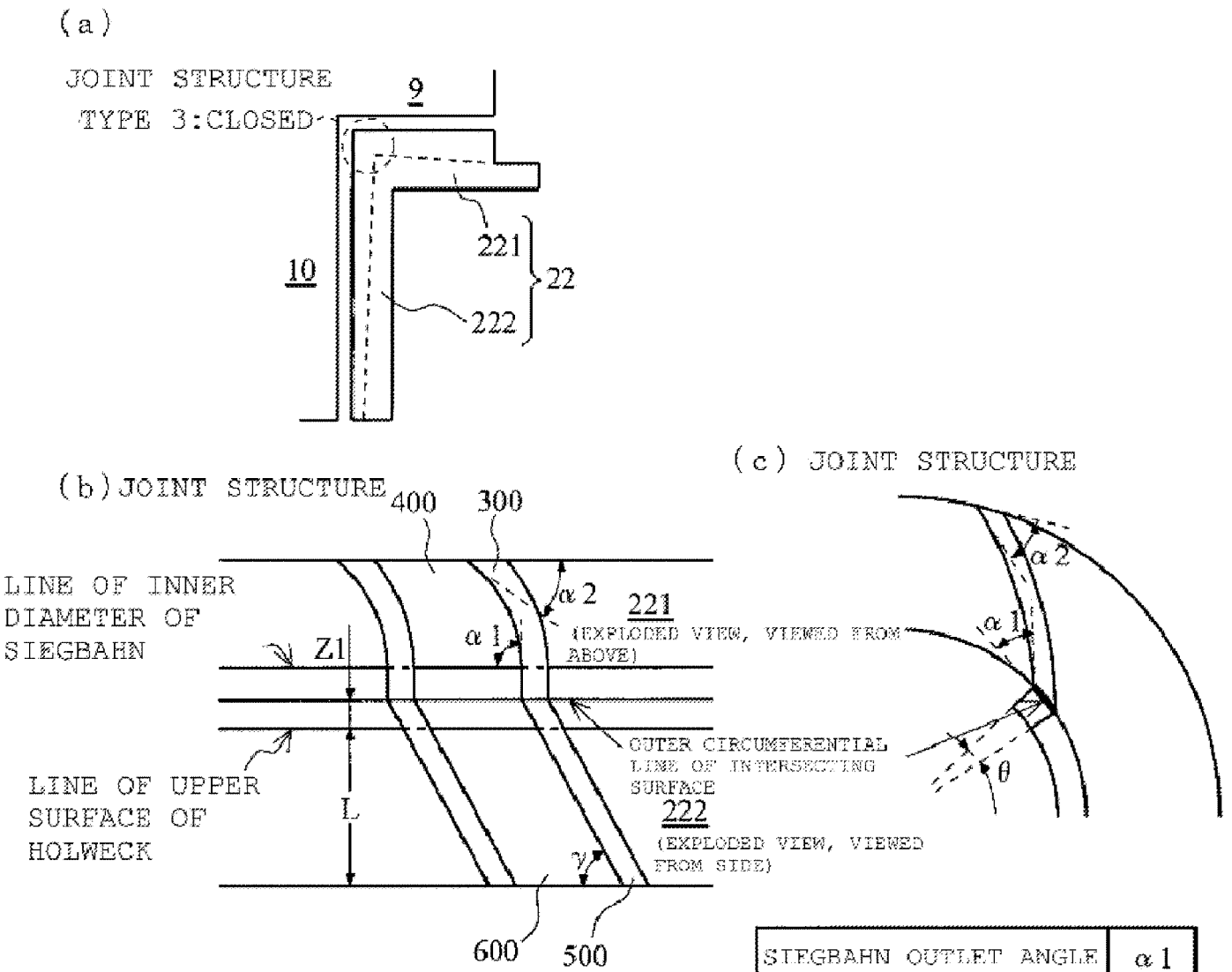
FIGS. 10A to 10C are diagrams for explaining the basic structure of the connected thread groove spacer according to Modification 2 of the embodiment of the present invention.

FIG. 8 and FIGS. 9A and 9B are diagrams for explaining a connected thread groove spacer 22 according to Modification 2 of the present embodiment, FIGS. 9A and 9B being diagrams showing an enlarged part of FIG. 8.

As shown in FIG. 8 and FIGS. 9A and 9B, in the connected thread groove spacer 22 according to Modification 2, unlike the connected thread groove spacer 20 or connected thread groove spacer 21 described above, a thread groove spacer axis perpendicular portion 221 and a thread groove spacer axis parallel portion 222 are joined in such a manner that each ridge portion (perpendicular portion ridge portion 300) of the spiral groove engraved in the thread groove spacer axis perpendicular portion 221 and each ridge portion (parallel portion ridge portion 500) of the thread groove formed in the thread groove spacer axis parallel portion 222 extend smoothly in a continuous manner without breaking, and a borderline surface 300*a* where the bottom surface of the perpendicular portion ridge portion 300 and the bottom surface of the perpendicular portion root portion 400 are in contact with each other and a surface extending from a borderline surface 500*a* where the bottom surface of the parallel portion ridge portion 500 and the parallel portion root portion 600 are in contact with each other, are configured to intersect with each other at the joint.

In the connected thread groove spacer 22 according to Modification 2, at the joint structure where the thread groove spacer axis perpendicular portion 221 and the thread groove spacer axis parallel portion 222 are connected (joined) to each other, the parallel portion ridge portion 500 of the thread groove spacer axis parallel portion 222 extends to the perpendicular portion ridge portion 300 of the thread groove spacer axis perpendicular portion 221, and the borderline surfaces between the ridge portions and root portions of these portions are connected to each other in a non-continuous manner.

Therefore, the joint structure is a structure with an intersecting surface where the perpendicular portion ridge portion 300 and the parallel portion ridge portion 500 intersect with each other, wherein the circumferential direction of the gas passage is closed.

FIGS. 10A to 10C are diagrams for explaining the basic structure of the connected thread groove spacer 22 according to Modification 2 of the present invention.

FIG. 10A is a diagram for explaining a position where the thread groove spacer axis perpendicular portion 221 and the thread groove spacer axis parallel portion 222 are connected to each other (a position of a joint structure), and FIGS. 10B and 10C are exploded views for explaining the joint structure in detail.

FIGS. 10B and 10C are exploded views in which the abovementioned joint of the connected thread groove spacer 22 is viewed from above (the rotor blade 9 side) and from the side (the rotor cylindrical portion 10).

As shown in FIGS. 10B and 10C, in the connected thread groove spacer 22 according to Modification 2, as with the embodiment and Modification 1 described above, the perpendicular portion ridge portion 300 and the perpendicular portion root portion 400 have a predetermined outlet angle ($\alpha$1: defined as a first angle) at the inner diameter side of the thread groove spacer axis perpendicular portion 221 that corresponds to the outlet of the Siegbahn portion. This outlet angle $\alpha$1 is formed by an inner diameter tangent of the thread groove spacer axis perpendicular portion 221 and an inner diameter-side tangent of the perpendicular portion ridge portion 300.

Also, as with the embodiment and Modification 1 described above, the perpendicular portion ridge portion 300 and the perpendicular portion root portion 400 have a predetermined inlet angle ($\alpha$2: defined as a second angle) at the outer diameter side of the thread groove spacer axis perpendicular portion 221 that corresponds to the inlet of the Siegbahn portion. This inlet angle $\alpha$2 is formed by an outer diameter tangent of the thread groove spacer axis perpendicular portion 221 and the inner diameter-side tangent of the perpendicular portion ridge portion 300.

In addition, the parallel portion ridge portion 500 and the parallel portion root portion 600 have a predetermined lead angle ($\gamma$) on the parallel portion root portion 600 side at the inner diameter side of the outlet (the outlet port 6 side) of the thread groove spacer axis parallel portion 222. In Modification 2, as with the embodiment and Modification 1 described above, the thread sectional area of the thread groove spacer axis parallel portion 222 in the joint structure becomes larger as the value of this lead angle $\gamma$ becomes smaller. Consequently, the phase angle ($\theta$) of each ridge portion of the Siegbahn portion becomes large as well.

In Modification 2, unlike the embodiment and Modification 1 described above, the phase angle $\theta$ of each ridge portion of the Siegbahn portion is defined by the outer circumferential line of the intersecting surface described above (FIG. 10C). In Modification 2, the outer circumferential line of the intersecting surface means the line on the perpendicular portion ridge portion 300 side that is obtained by extending the parallel portion ridge portion 500 of the thread groove spacer axis parallel portion 222, past the thread groove spacer axis parallel portion 222, and crossing this extended line with the perpendicular portion ridge portion 300 of the thread groove spacer axis perpendicular portion 221.

As shown in FIGS. 10B and 10C, in the connected thread groove spacer 22 according to Modification 2, unlike the embodiment and Modification 1 described above, the perpendicular portion ridge portion 300 of the thread groove spacer axis perpendicular portion 221 and the parallel portion root portion 600 of the thread groove spacer axis parallel portion 222 intersect with each other in the joint structure, forming an intersecting surface.

In Modification 2, therefore, since the intersecting surface is formed in the joint structure, the top surface of the perpendicular portion ridge portion 300 of the thread groove spacer axis perpendicular portion 221 and the top surface of the parallel portion ridge portion 500 of the thread groove spacer axis parallel portion 222 can be connected (joined) smoothly in a continuous manner without breaking. Consequently, the thread groove spacer axis perpendicular portion 221 and the thread groove spacer axis parallel portion 222 can be connected (joined) smoothly.

(ii-4) Angles (Gradient) in Connected Thread Groove Spacer

Figure 11:
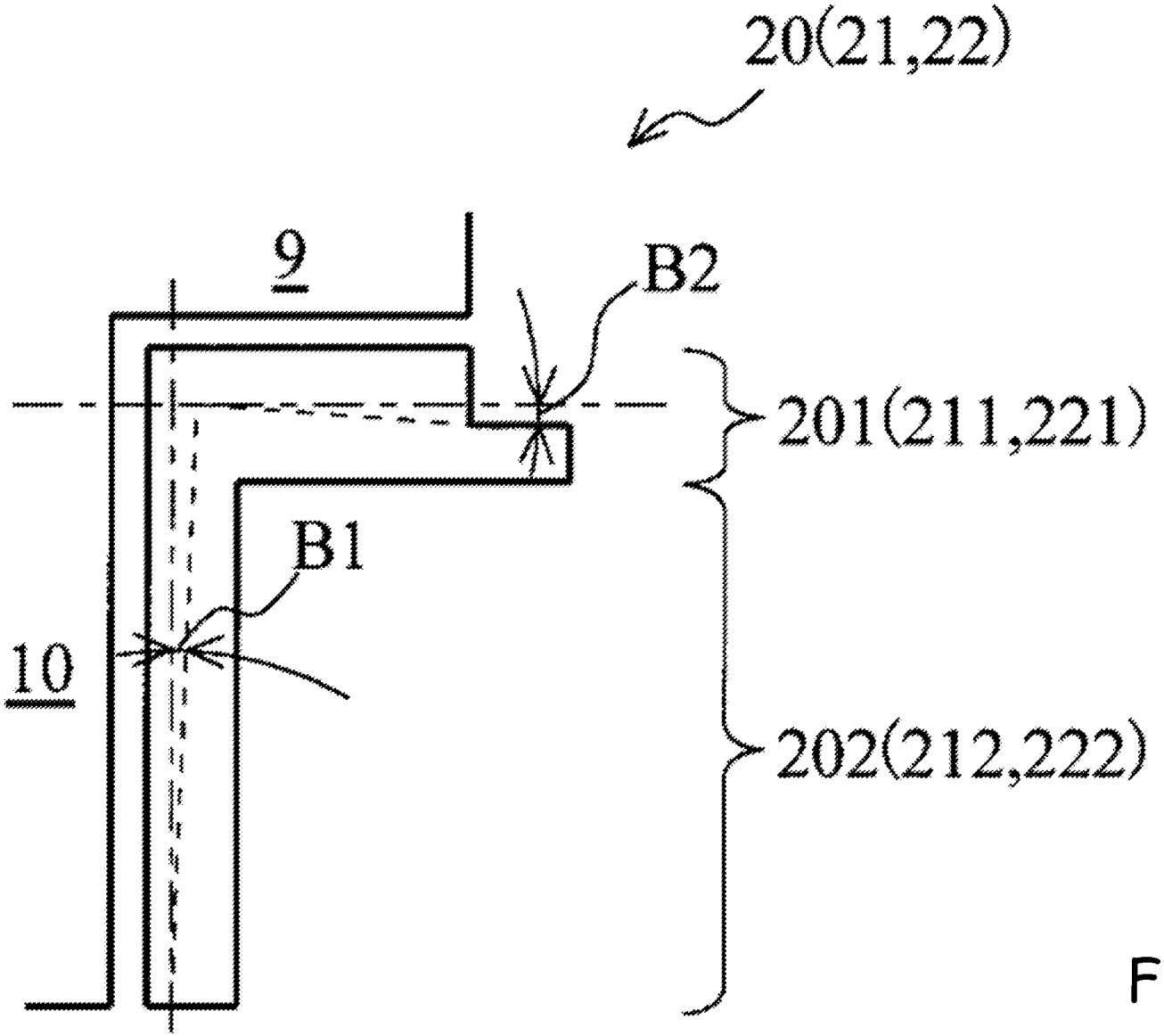
FIG. 11 is a diagram for explaining the connected thread groove spacers according to the embodiment and each modification of the present invention.

FIG. 11 is a diagram for explaining the joint structures of the connected thread groove spacers 20 (21, 22) of the embodiment and each modification according to the present invention.

Note that the details described hereinafter with reference to FIG. 11 use the connected thread groove spacer 20, but these details are similarly applied to the connected thread groove spacer 21 according to Modification 1 and the connected thread groove spacer 22 according to Modification 2. Therefore, reference numerals indicating the connected thread groove spacer 21 and the connected thread groove spacer 22 (as well as the related elements) are used to describe the connected thread groove spacer 21 and the connected thread groove spacer 22 in FIG. 11, and the descriptions using the connected thread groove spacer 21 and the connected thread groove spacer 22 are omitted.

As shown in FIG. 11, in the embodiment and each of the modifications according to the present invention, a thread depth angle B1 (first gradient angle), which is an angle (gradient) formed by the axis and the thread depth of the thread groove formed in the thread groove spacer axis parallel portion 202, and a groove depth angle B2 (second gradient angle), which is an angle (gradient) formed by the axis perpendicular line and the groove depth of the spiral groove formed in the thread groove spacer axis perpendicular portion 201, are configured to have the relation of B2≥B1.

This configuration can exhibit high exhaust performance of the connected thread groove spacer 20.

Figure 12:
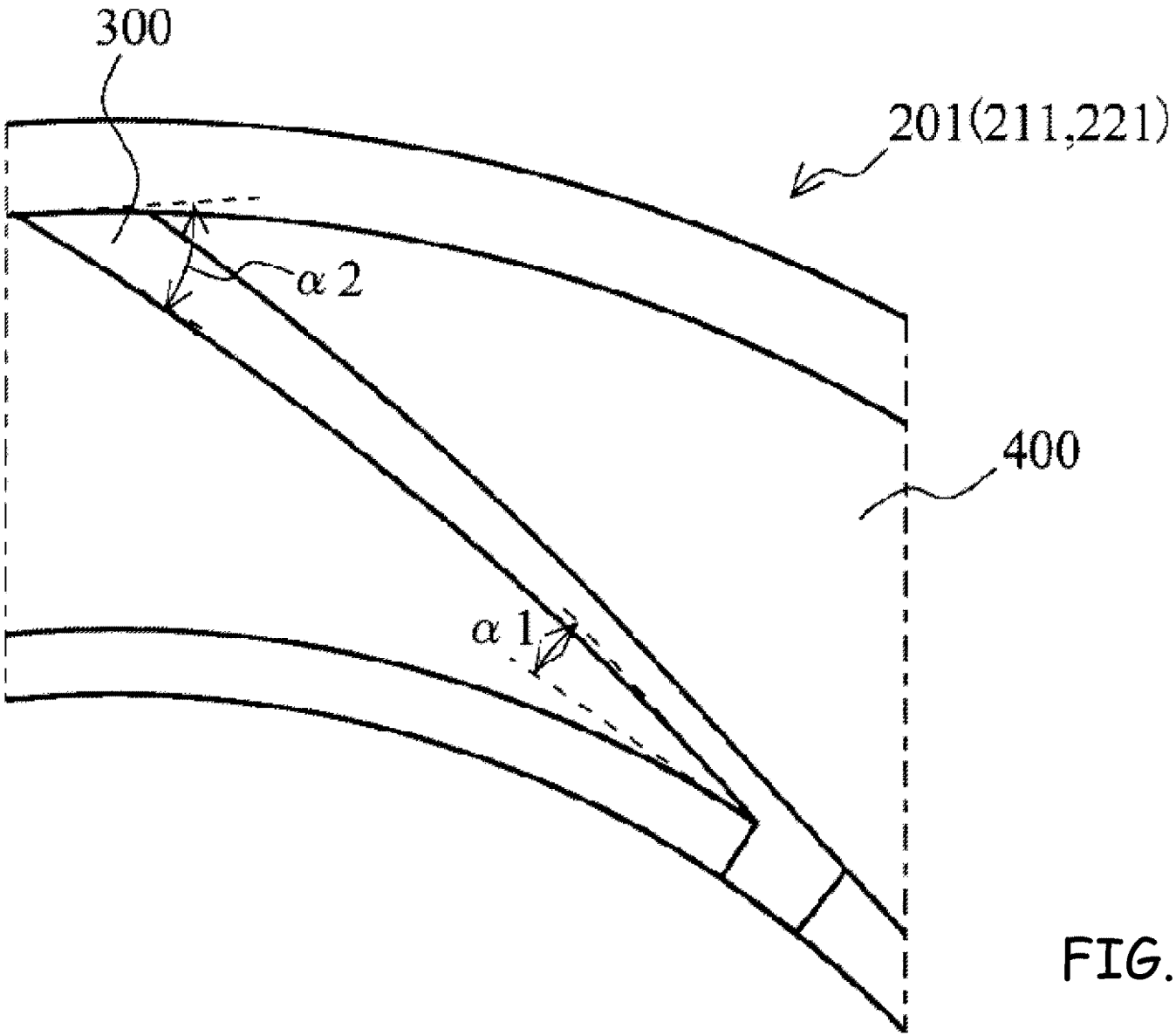
FIG. 12 is a diagram for explaining the structures of the connected thread groove spacers according to the embodiment and each modification of the present invention.

FIG. 12 is a diagram for explaining the structures of the connected thread groove spacers 20 (21, 22) according to the embodiment and each modification of the present invention.

Note that the details described hereinafter with reference to FIG. 12 use the thread groove spacer axis perpendicular portion 201 (connected thread groove spacer 20), but these details are similarly applied to the thread groove spacer axis perpendicular portion 211 (connected thread groove spacer 21) according to Modification 1 and the thread groove spacer axis perpendicular portion 221 (connected thread groove spacer 22) according to Modification 2. Therefore, reference numerals indicating the thread groove spacer axis perpendicular portion 211 and the thread groove spacer axis perpendicular portion 221 are used to describe the thread groove spacer axis perpendicular portion 211 and the thread groove spacer axis perpendicular portion 221 in FIG. 12, and the descriptions using the thread groove spacer axis perpendicular portion 211 and the thread groove spacer axis perpendicular portion 221 are omitted.

FIG. 12 shows $\alpha 1$ and $\alpha 2$ described in FIGS. 5B and 5C, and FIGS. 10B and 10C.

In the embodiment and each of the modifications according to the present invention, the following relation is established between the outlet angle $\alpha 1$ and the inlet angle $\alpha 2$.

$$\alpha 1 \leq \alpha 2 \quad (1)$$

$$15° < \alpha 1, \text{ and } \alpha 2 < 25° \quad (2)$$

This configuration can exhibit high exhaust performance of the connected thread groove spacer 20 (21, 22).

Figure 13:
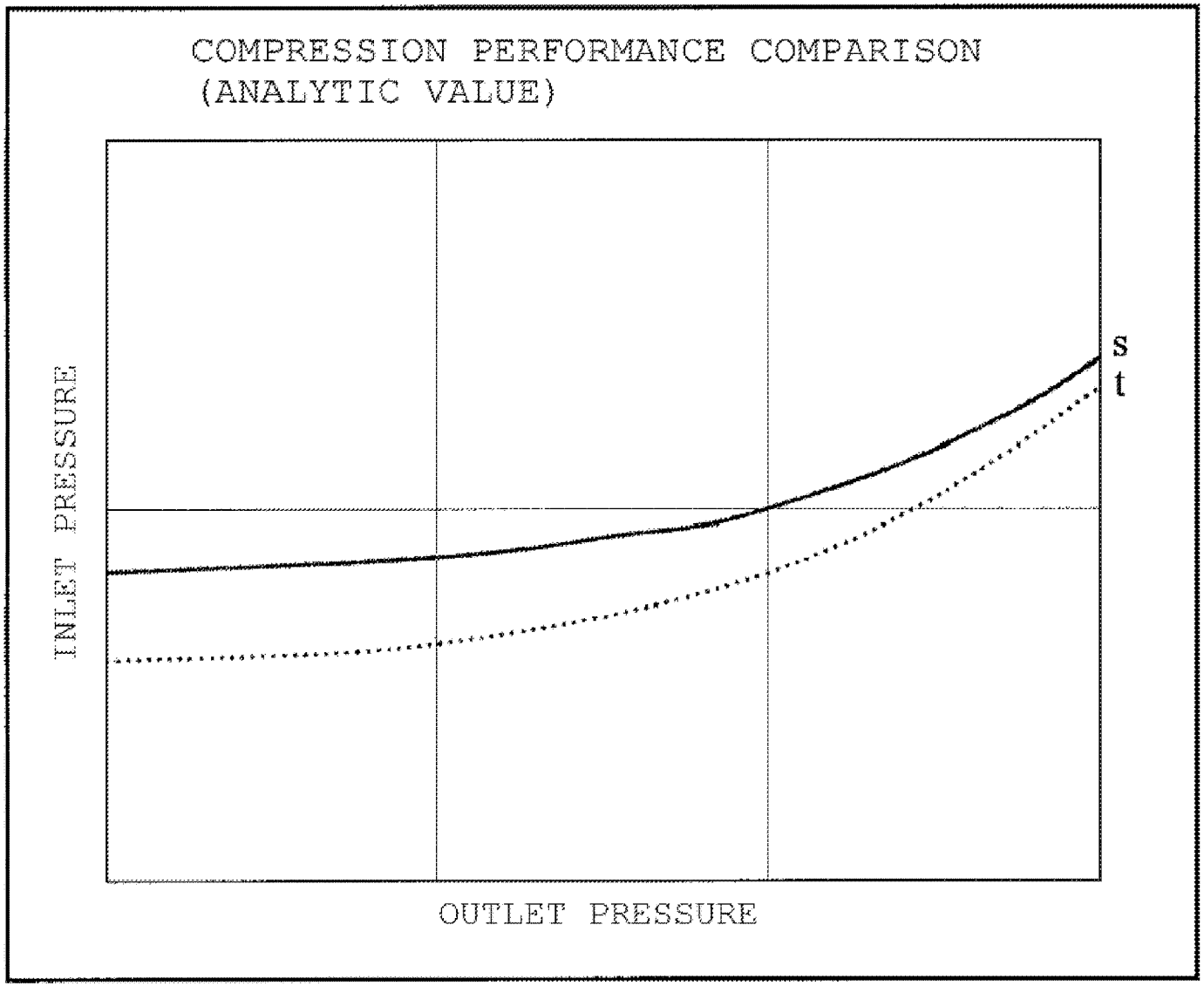
FIG. 13 is a diagram for explaining compression performance of a vacuum pump that has the connected thread groove spacer according to the embodiment of the present invention.
Figure 14:
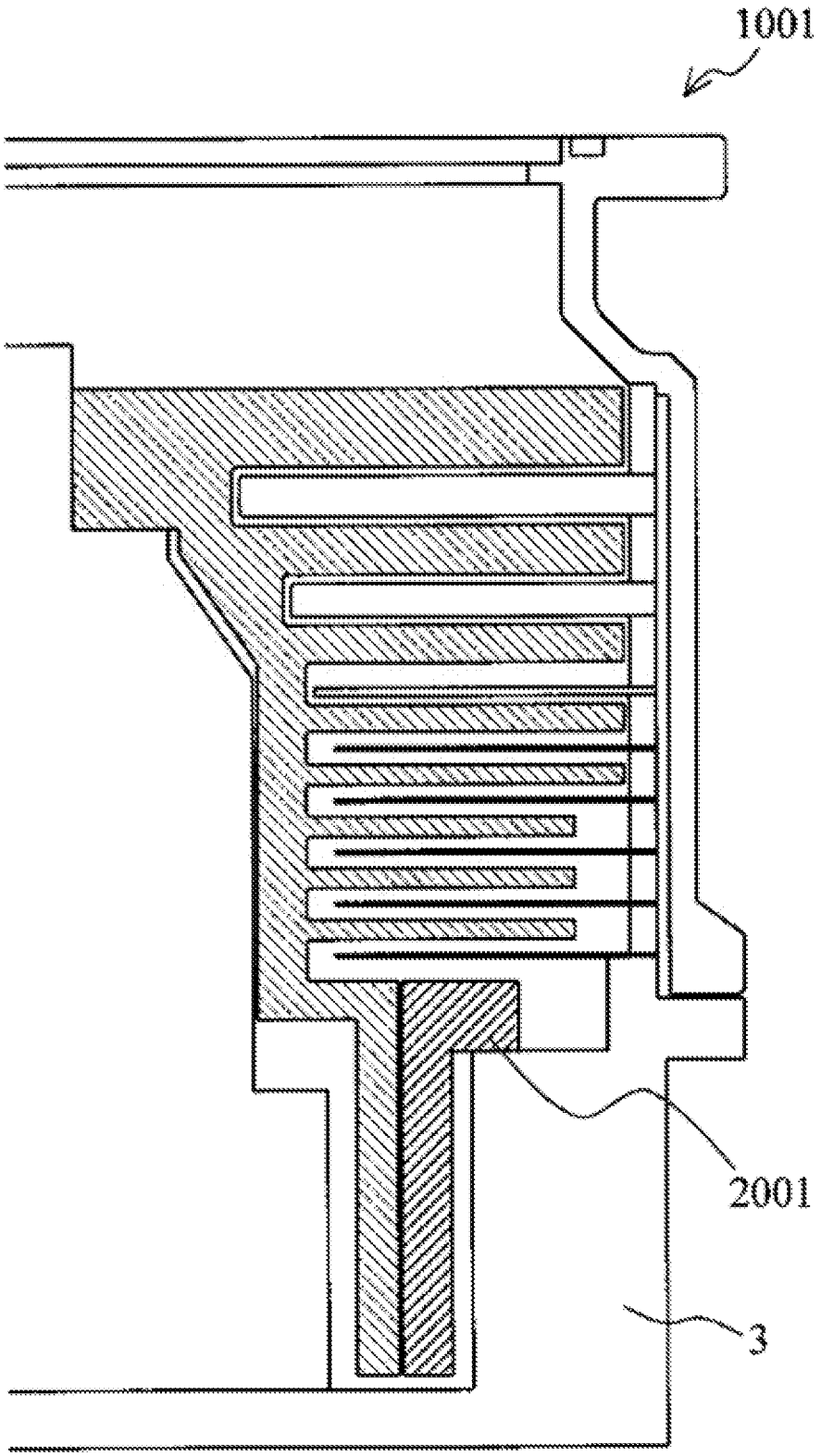
FIG. 14 is a diagram for explaining the prior art (1-pass thread type).

FIG. 13 is a diagram for explaining the compression performance of the vacuum pump 1 having the connected thread groove spacer 22 out of the connected thread groove spacers 20 (21, 22) according to the embodiment and each modification of the present invention.

In FIG. 13, the vertical axis represents inlet pressure (Torr) of the vacuum pump 1 having the connected thread groove spacer 22, and the horizontal axis represents outlet pressure (Torr) of the vacuum pump 1 having the connected thread groove spacer 22. Also in the diagram, "s" represents an analytic value (value obtained in a simulation) of the conventional vacuum pump 1001 in which the 1-pass thread groove spacer 2001 is provided, and "t" represents an analytic value of the vacuum pump 1 in which the connected thread groove spacer 22 is provided.

As shown in FIG. 13, "t", indicating high compression performance regardless of the outlet pressure, shows that the exhaust performance of the vacuum pump 1 with the connected thread groove spacer 22 is improved more than that of the conventional vacuum pump 1001.

According to this configuration, in the connected thread groove spacers 20 (21, 22) according to the embodiment and each modification of the present invention and the vacuum pump 1 in which the connected thread groove spacer 20 (21, 22) is provided, the gas is compressed in a direction perpendicular to the axial direction by the Siegbahn portion, which is configured by putting together (or integrating) the connected thread groove spacer 20 (21, 22) as a single part, and then the gas is compressed by the provided thread groove pump portion (Holweck) in the axial direction. Since the flow channel is made longer by connecting the passage extending in the direction perpendicular to the axial direction and the passage extending in the direction parallel to the axial direction (configuring the shape of an "L" when viewed in axial cross section), the height of the thread groove pump portion can be reduced while keeping the exhaust performance.

As a result, the size of the entire pump can be reduced while keeping the exhaust performance thereof, resulting in reduction of the manufacturing cost.

Note that the embodiment and modifications of the present invention may be combined as necessary.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A connected thread groove spacer comprising:

a spiral groove portion which has a disc shape and in which a spiral groove with a spiral ridge portion and a spiral root portion is engraved; and a thread groove portion which has a cylindrical shape and in which a thread groove with a thread ridge portion and a thread root portion is formed, the thread groove portion being connected to the spiral groove portion, wherein a flow channel of the spiral groove portion is connected to a flow channel of the thread groove portion, a value of a first gradient angle, which is a gradient angle between an axis and a thread depth in the thread groove portion, is smaller than a value of a second gradient angle, which is a gradient angle between an axis perpendicular line perpendicular to the axis and a groove depth in the spiral groove portion, and the value of the first gradient angle is larger than zero.

2. The connected thread groove spacer according to claim 1, wherein, in the spiral groove portion and the thread groove portion, at least one of borderlines between the spiral ridge portion and the spiral root portion, or a first extended line extending from this borderline is connected in a continuous manner to at least one of borderlines between the thread ridge portion and the thread root portion, or a second extended line extending from this borderline, at a connection portion where the spiral groove portion and the thread groove portion are connected to each other.

3. The connected thread groove spacer according to claim 2, further, wherein a top surface of the spiral ridge portion and a top surface of the thread ridge portion are connected to each other at the connection portion in a non-continuous manner.

4. The connected thread groove spacer according to claim 2, further, wherein the spiral ridge portion and the thread ridge portion are connected to each other at the connection portion in a continuous manner.

5. The connected thread groove spacer according to claim 1, wherein, in the spiral groove portion and the thread groove portion, the spiral ridge portion and the thread ridge portion are connected to each other in a continuous manner at a connection portion where the spiral groove portion and the thread groove portion are connected to each other.

6. The connected thread groove spacer according to claim 5, further, wherein the spiral ridge portion and the thread ridge portion intersect with each other by being connected to each other at the connection portion, with a borderline surface between the spiral ridge portion and the spiral root portion and a borderline surface between the thread ridge portion and the thread root portion being disposed in a non-continuous manner.

7. The connected thread groove spacer according to claim 1, wherein a value of a first angle formed by an inner diameter tangent of the spiral groove portion and an inner diameter-side tangent of the spiral ridge portion is equal to or smaller than a value of a second angle formed by an outer diameter tangent of the spiral groove portion and the inner diameter-side tangent of the spiral ridge portion, the first angle being formed to be larger than 15° and the second angle being formed to be smaller than 25°.

8. The connected thread groove spacer according to claim 1, wherein the spiral groove portion and the thread groove portion are formed integrally.

9. A vacuum pump comprising:

a housing in which an inlet port and an outlet port are formed;

a rotating shaft that is enclosed in the housing and supported rotatably;

a rotor blade that is provided on the rotating shaft;

a stator blade that is disposed concentrically with the rotor blade and axially opposes the rotor blade with a gap therebetween; and a thread groove pump mechanism that has the connected thread groove spacer described in claim 1 that is fixed to the housing.

* * * * *